US005637247A

United States Patent [19]

Flynn, Jr.

[11] Patent Number: 5,637,247

[45] Date of Patent: Jun. 10, 1997

[54] ELECTRICIALLY HEATED HINGED MAT

[76] Inventor: Joseph Flynn, Jr., 333 N. Virginia Ave., N. Massapequa, N.Y. 11758

[21] Appl. No.: 367,884

[22] Filed: Jan. 3, 1995

[51] Int. Cl.[6] ..... H05B 3/34

[52] U.S. Cl. ..... 219/213; 219/528; 219/544; 219/549; 219/524

[58] Field of Search ..... 219/213, 528, 219/524–525, 544, 549; 338/210, 283, 280, 290, 293, 310, 312; 160/229.1

[56] References Cited

U.S. PATENT DOCUMENTS

| | | | |
|---|---|---|---|
| 836,282 | 11/1906 | Shellhamer | 219/528 |
| 1,172,025 | 2/1916 | Homan | 219/528 |
| 1,443,036 | 1/1923 | Panza | 219/525 |
| 2,052,644 | 9/1936 | Murphy | 219/528 |
| 2,318,109 | 5/1943 | Schultz | 219/524 |
| 2,617,011 | 11/1952 | MacKendrick | 219/528 |
| 2,735,926 | 2/1956 | Langlois | 219/528 |
| 2,745,942 | 5/1956 | Cohen | 219/528 |
| 2,845,519 | 7/1958 | Willat | 219/528 |
| 3,014,117 | 12/1961 | Madding | 392/443 |
| 3,152,313 | 10/1964 | Barbour et al. | 338/214 |
| 3,281,578 | 10/1966 | Chapman, Jr. | 219/528 |
| 4,363,947 | 12/1982 | Bergersen | 219/528 |
| 5,451,743 | 9/1995 | du Preez | 219/525 |

*Primary Examiner*—Teresa J. Walberg
*Assistant Examiner*—Raphael Valencia
*Attorney, Agent, or Firm*—Michael I. Kroll

[57] ABSTRACT

A flexible waterproof mat has an elongated serpentine heating element extending throughout the middle thereof. The heating element is divided into portions and the mat is divided into a segments separated by hinges. Each hinge consists of interlocking flat knuckles formed by the mat. Each portion of the heating element is located in each segment of the mat and is provided with fingers that extend through the knuckles. An electrically conductive pintle extends transversely through the interlocking flat knuckles in order to electrically connect the portions of the heating element together.

3 Claims, 3 Drawing Sheets

ELECTRICIALLY HEATED HINGED MAT

BACKGROUND OF THE INVENTION

1. Field of the Invention

The instant invention relates generally to heating mats and more specifically it relates to an electric snow tarpaulin.

2. Description of the Prior Art

Numerous heating mats have been provided in prior art. For example, U.S. Pat. Nos. 3,806,702 to Spencer; 3,808,403 to Kanaya et al.; 4,967,057 to Bayless et al. and 5,003,157 to Hargrove all are illustrative of such prior art. While these units may be suitable for the particular purpose to which they address, they would not be as suitable for the purposes of the present invention as heretofore described.

U.S. Pat. No. 3,806,702 to Spencer shows a weatherproof electrically insulative mat has an electrical heat producing conductor therein and is adapted for placement on an exterior surface to prevent accumulation of snow on such surface. A control system for supplying current to the conductor includes a precipitation sensor, a temperature sensor and a control unit responsive to the sensors. Power is supplied to the conductor in the mat only when there is precipitation and the temperature is below thirty five degrees Fahrenheit. An improved mat structure is approximately symmetrical of the central plane thereof, so that when one side of the mat wears the mat can be reversed.

U.S. Pat. No. 3,808,403 Yoshinosuke et al. shows a heating unit sheet composed of an electroconductive high molecular material and has a high degree of safety and excellent flexibility. It is useful in many various applications, equipped with electrodes and coated with insulating materials.

U.S. Pat. No. 4,967,057 to Bayless et al. shows individual electrically heated mats, self-regulated by use of an electrical element whose resistance varies proportionately with its temperature are used for covering walking areas, to prevent accumulation of snow and ice. Each mat is provided with male and female electrical connections on the ends of short power cords, to permit any number of mats to be chained together in electrical parallel and to be used to cover, for example, a flight of stairs by positioning one mat on each stair.

U.S. Pat. No. 5,003,157 to Hargrove shows an apparatus utilizing a flexible web construction, includes a series of electrical heating resistance elements directed therethrough. The mat contains a ribbed upper surface overlying a ribbed bottom surface. The upper surface has sloping side walls positioned medially about a central ridge to direct fluid downwardly from an upper surface of the mat. Hollow chambers are optionally formed throughout the mat longitudinally thereof, overlying the electric coils to cushion the coils and simultaneously produce heat chambers for maintaining a constant temperature throughout the web construction. Further, fiber optic cables may be placed in side chambers longitudinally coextensive with side edges of the web, to illuminate boundary portions of the web for individuals during limited light conditions.

SUMMARY OF THE INVENTION

A primary object of the present invention is to provide an electric snow tarpaulin that will overcome the shortcomings of the prior art devices.

Another object is to provide and electric snow tarpaulin that is waterproof and can be rolled out onto a driveway, sidewalk or motor vehicle and then plugged into an electrical outlet prior to a snow fall, so that it will melt any snow on impact, to keep the driveway, sidewalk or motor vehicle free of the snow.

An additional object is to provide an electric snow tarpaulin that can be rolled up into a small package when not in use and placed into storage for future deployment.

A further object is to provide an electric snow tarpaulin that is simple and easy to use.

A still further object is to provide an electric snow tarpaulin that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figures 1, 2, 3A, 3B:
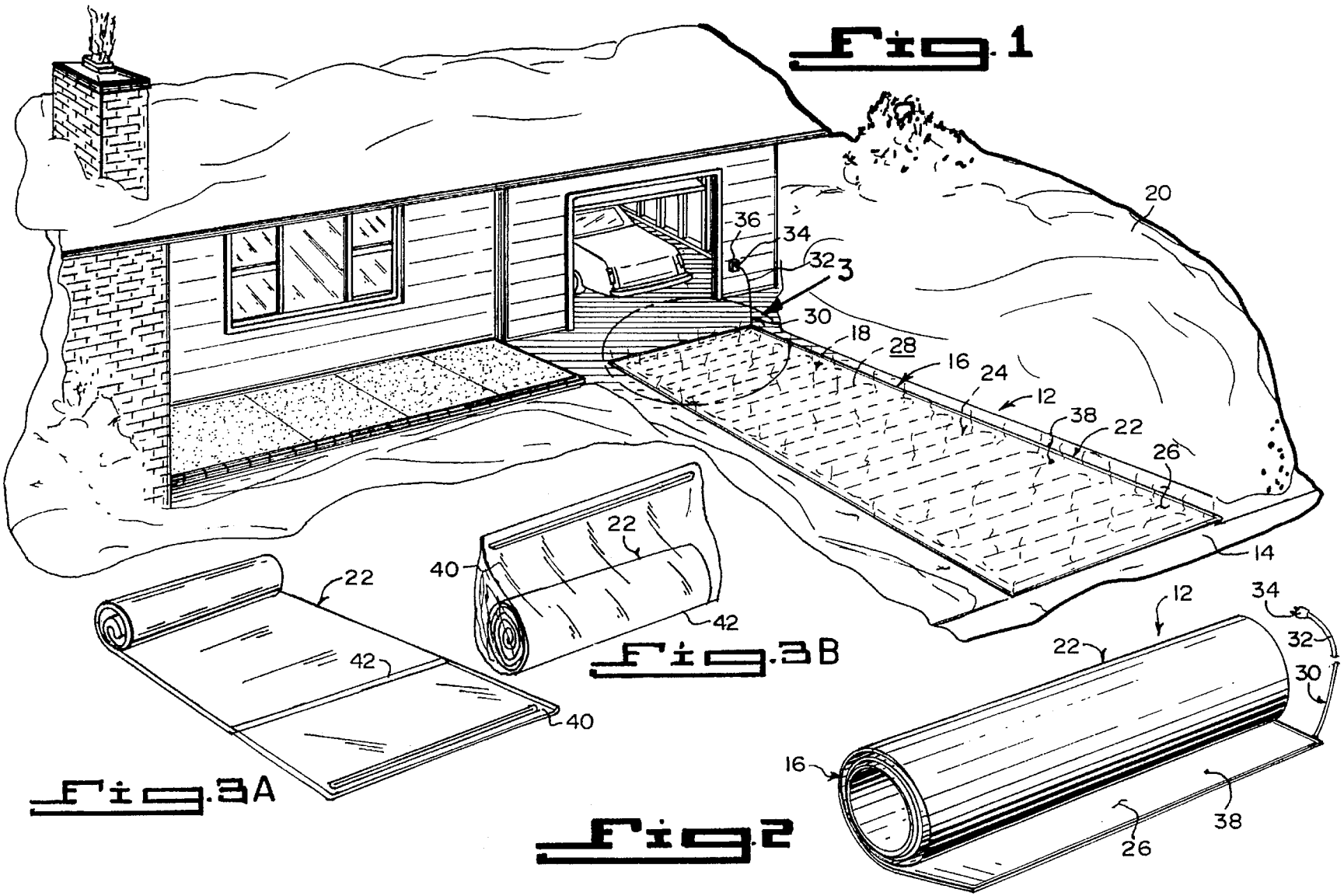
FIG. 1 is a perspective view showing a first embodiment of the instant invention installed in a driveway of a house, keeping the driveway free of snow.
FIG. 2 is a perspective view of the first embodiment rolled up for storage.
FIG. 3A is a perspective view of a second embodiment of the instant invention having a sealable storage bag attached thereto and partly rolled up.
FIG. 3B is a perspective view of the instant invention in a sealable storage bag.
Figure 3:
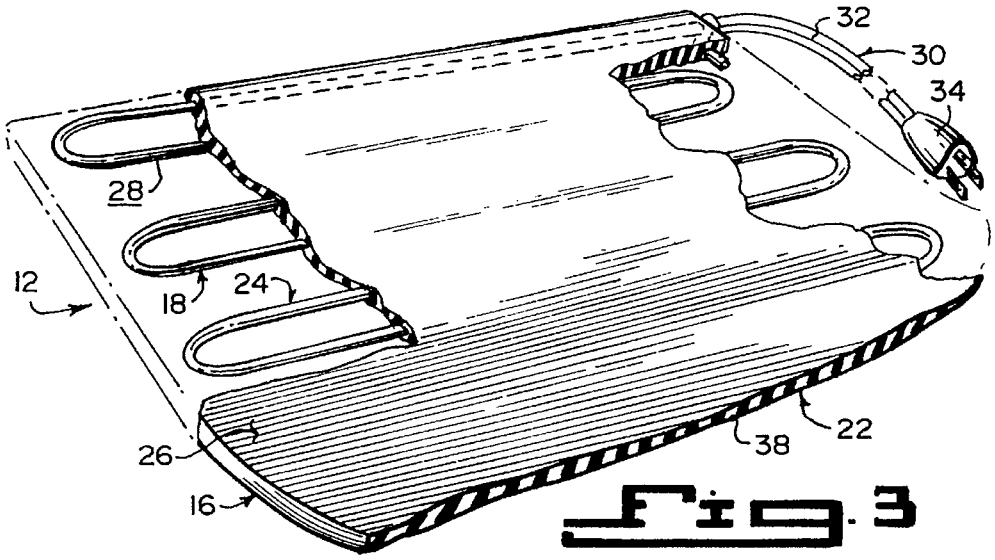
FIG. 3 is an enlarged perspective view as indicated by arrow 3 in FIG. 1, with parts broken away, showing the heating element therein.

Turning now descriptively to the drawings, in which similar reference characters denote similar elements throughout the several views, FIGS. 1 through 3 illustrate an electric snow tarpaulin 12, for preventing snow accumulation on an outdoor surface 14 comprising a sheet 16 conformable to the outdoor surface 14, prior to a snowfall. A component 18 sealed within the sheet is for producing heat. Any snow 20 on impact with the sheet 16 will melt away to keep the outdoor surface 14 free of the snow 20. The outdoor surface 14 can be a walkway, driveway, porch, etc.

The sheet 16 is a generally rectangular flexible waterproof mat 22. The heat producing component 18 is a flexible elongated heating element 24 extending throughout the middle of the mat 22, so that either exterior flat side 26 of the mat 22 can be placed upon the outdoor surface 14. The heating element 24 is an electrically operated heater wire 28, having a serpentine configuration within the mat 22.

An assembly 30 is for supplying electric power to the heater wire 28. The electric power supplying assembly 30 includes an elongated electric cord 32 connected to the heater wire 28 at one end of the mat 24. An electric plug 34 is on a distal end of the electric cord 32. The electric plug 34 can engage with an electric wall socket 36, to carry electricity to the heater wire 28 through the electric cord 32. The generally rectangular flexible waterproof mat 22 is fabricated out of a lightweight rubber material 38.

As shown in FIGS. 3A and 3B, a sealable storage bag 40 can be attached to one end 42 of the mat 22. The mat 22 can be rolled up and inserted into the sealable storage bag 40 for protection when not in use.

Figure 4:
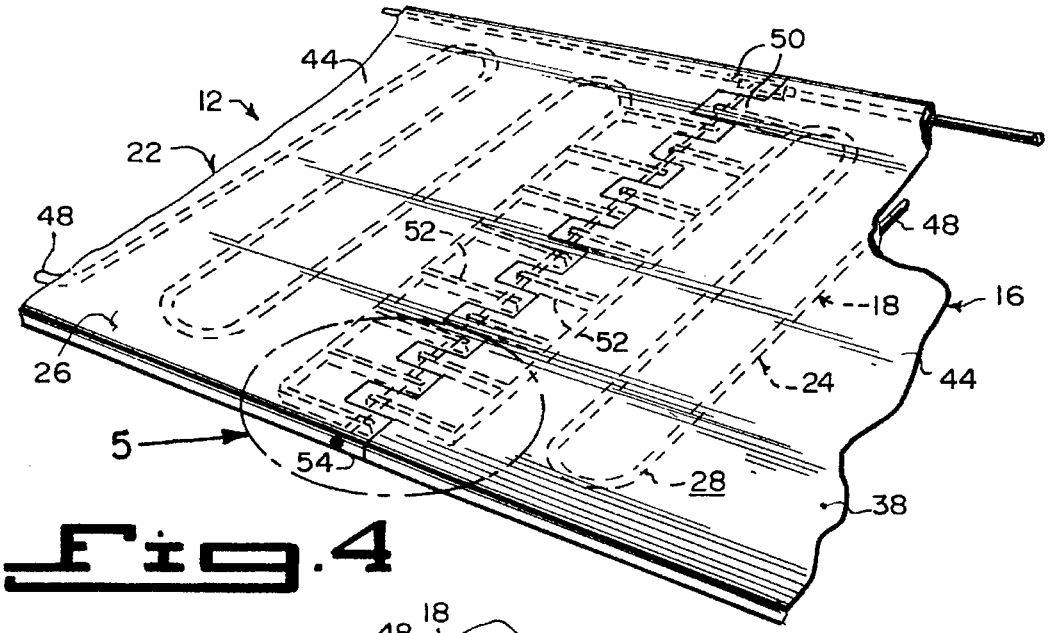
FIG. 4 is a perspective view of a portion of a third embodiment of the instant invention being in foldable segments for storage.
Figure 5:
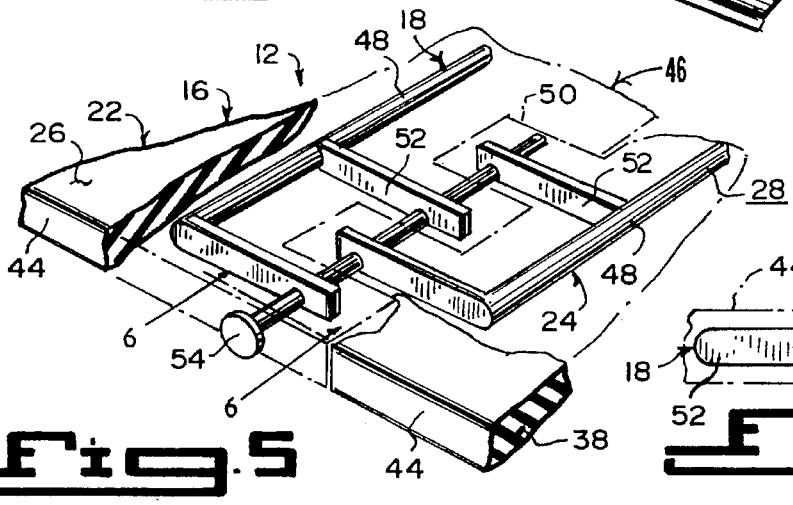
FIG. 5 is an enlarged perspective view as indicated by arrow 5 in FIG. 4, with parts broken away to show the foldable heating element therein.
Figure 6:
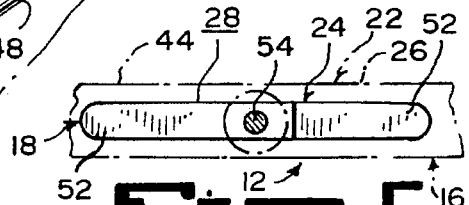
FIG. 6 is a cross sectional view taken along line 6—6 in FIG. 5.

The mat 22 in FIGS. 4, 5 and 6 is divided into a plurality of segments 44. A plurality of hinges 48 are formed into the mat 22. Each hinge 46 is located between two of the segments 44 of the mat 22. The heater wire 28 is divided into a plurality of portions 48. Each portion 46 is located in each segment 44 of the mat 22, so that the mat 22 can be folded up when not in use.

Each hinge 46 consists of a plurality of interlocking flat knuckles 50 formed from the rubber material 38 of the mat 22. Two mating portions 48 of the heater wire 28 have a plurality of fingers 52. Each finger 52 extends through one flat knuckle 50. An electrically conductive pintle 54 extends transversely through the interlocking flat knuckles 50 and the fingers 52, so as to electrically interconnect the portions 48 of the heater wire 28 together.

Figure 7:
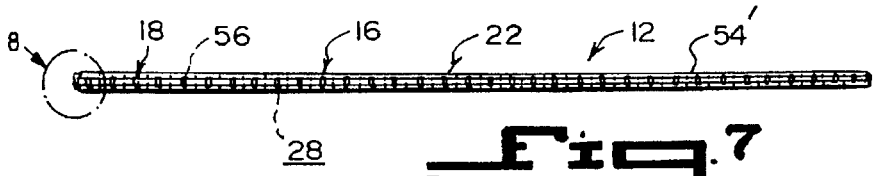
FIG. 7 is a side view of a fourth embodiment of the instant invention being modular and reinforced, so that a motor vehicle can be parked thereon.
Figure 8:
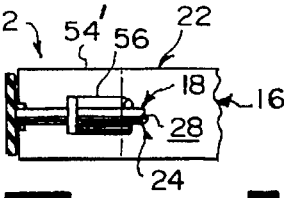
FIG. 8 is an enlarged diagrammatic cross sectional view as indicated by arrow 8 in FIG. 7, showing the internal modular and reinforced construction therein.

In FIGS. 7 and 8, the mat 22 is of a modular construction 54. The heater wire 28 is reinforced with a frame 56 therethrough. A heavy object, such as a motor vehicle 57, can be place upon the mat 22 on the outdoor surface 14 without damaging the heater wire 28.

Figure 9:
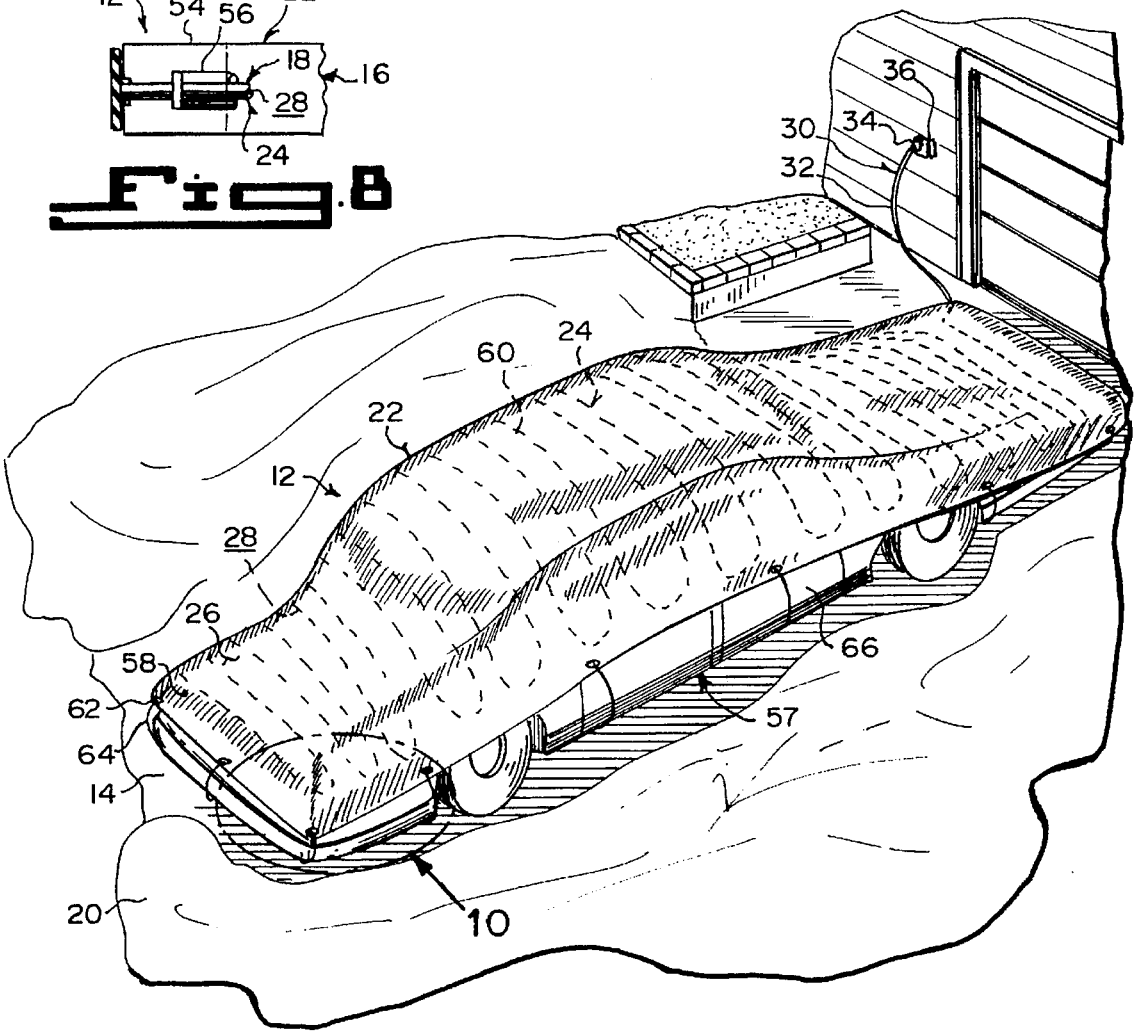
FIG. 9 is a perspective view of a fifth embodiment installed over a motor vehicle to keep it free of snow.
Figure 10:
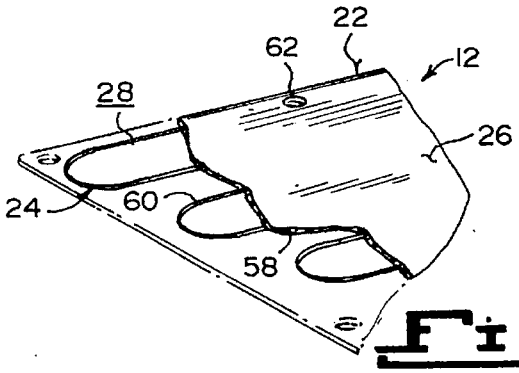
FIG. 10 is an enlarged cross sectional view as indicated by arrow 10 in FIG. 9, with parts broken away showing the heating element therein.

In FIGS. 9 and 10, the generally rectangular flexible waterproof mat 22 is fabricated out of a strong thin plastic material 58. The heater wire 28 is a thin filament strip 60. The mat 22 has a plurality of eyelets 62, spaced about its perimeter. A plurality of lines 64 are provided. Each line 64 extends through one eyelet 62 to retain the mat to the outdoor surface, being a body 66 of a motor vehicle 57.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An electric snow tarpaulin for preventing snow accumulation on an outdoor surface comprising:

a) a sheet consisting of a generally rectangular flexible waterproof mat of lightweight rubber material conformable to and covering an outdoor surface to be protected from a snowfall;

b) means comprising a flexible elongated heating element extending through and sealed within said sheet for producing heat to melt any snow falling thereon to keep said outdoor surface free of snow, said heating element being an electrically operated heater wire having a serpentine configuration; and c) said mat divided into a plurality of segments to permit said mat to be folded up when not in use, a plurality of hinges formed into said mat between adjacent segments of said mat, and said heater wire divided into a plurality of portions with each portion located in each said segment of said mat, each of said hinges comprising a plurality of interlocking flat knuckles formed from said rubber material of said mat, the heater wire in each said segment having mating portions and a plurality of fingers with each finger extending into a flat knuckle, and an electrical conductive pintle extending transversely through said interlocking flat knuckles and said fingers to electrically interconnect said mating portions of said heater wire together.

2. An electric snow tarpaulin as recited in claim 1, further including means for supplying electric power to said heater wire.

3. An electric snow tarpaulin as recited in claim 2, wherein said electric power supplying means includes:

a) an elongated electric cord connected to said heater wire at one end of said mat; and b) an electric plug on a distal end of said electric cord, whereby said electric plug can engage with an electric wall socket to carry electricity to said heater wire through said electric cord.

* * * * *